US008191979B2

(12) United States Patent
Matsumoto et al.

(10) Patent No.: US 8,191,979 B2
(45) Date of Patent: Jun. 5, 2012

(54) DEPOSITING DROPS ON A SUBSTRATE CARRIED BY A STAGE

(75) Inventors: Nobuo Matsumoto, Cupertino, CA (US); Andreas Bibl, Los Altos, CA (US); Martin Schoeppler, Los Altos, CA (US); Deane A. Gardner, Cupertino, CA (US); John C. Batterton, Los Gatos, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 476 days.

(21) Appl. No.: 12/416,756

(22) Filed: Apr. 1, 2009

(65) Prior Publication Data

US 2010/0253721 A1 Oct. 7, 2010

(51) Int. Cl.
*B41J 29/38* (2006.01)
*B41J 2/01* (2006.01)

(52) U.S. Cl. ..... 347/9; 347/16; 347/101; 347/104; 347/105

(58) Field of Classification Search ..... 347/4, 8–9, 347/16, 19, 101, 104–105
See application file for complete search history.

(56) References Cited

U.S. PATENT DOCUMENTS 5,274,399 A * 12/1993 Uchida et al. ..... 346/134
6,814,435 B1 * 11/2004 Shimada et al. ..... 347/93
7,681,978 B2 * 3/2010 Hirato ..... 347/19
7,931,348 B2 * 4/2011 Kida ..... 347/19
2002/0018097 A1 2/2002 Kitahara et al.
2007/0091139 A1 * 4/2007 Takatsuka ..... 347/29
2007/0115319 A1 * 5/2007 Ishikawa ..... 347/33
2007/0165092 A1 7/2007 Kito
2007/0206038 A1 9/2007 Baker
2008/0012920 A1 * 1/2008 Matsuda ..... 347/104

FOREIGN PATENT DOCUMENTS

JP 04-284273 10/1992
JP 11-001030 1/1999
JP 11-165432 6/1999

OTHER PUBLICATIONS

Authorized Officer Sang Bae Kim, International Search Report and Written Opinion for International Application No. PCT/US2010/028005, mailed Nov. 16, 2010, 8 pages.

* cited by examiner

*Primary Examiner* — Jason Uhlenhake
(74) *Attorney, Agent, or Firm* — Fish & Richardson P.C.

(57) ABSTRACT

A device for depositing drops includes a head configured to eject drops on a region of a substrate; a stage configured to hold the substrate while the head ejects drops on the region of the substrate; a first transporting device configured to transport the substrate in a transporting direction onto the stage; and a second transporting device configured to transport the substrate in the transporting direction off the stage. The stage and at least one of the first transporting device or the second transporting device are movable together in the transporting direction.

28 Claims, 6 Drawing Sheets

DEPOSITING DROPS ON A SUBSTRATE CARRIED BY A STAGE

BACKGROUND

Ink jet printers are one type of apparatus for depositing drops on a substrate. Ink jet printers typically include an ink path from an ink supply to a nozzle path. The nozzle path terminates in a nozzle opening from which ink drops are ejected. Ink drop ejection is typically controlled by pressurizing ink in the ink path with an actuator, which may be, for example, a piezoelectric deflector, a thermal bubble jet generator, or an electrostatically deflected element. A typical print head has an array of ink paths with corresponding nozzle openings and associated actuators. Drop ejection from each nozzle opening can be independently controlled. In a drop-on-demand print head, each actuator is fired to selectively eject a drop at a specific pixel location of an image as the print assembly and a printing substrate are moved relative to one another. In high performance print heads, the nozzle openings typically have a diameter of 50 microns or less, e.g. around 25 microns, are separated at a pitch of more than 300 nozzles/inch.

In some systems, a substrate is transported relative to the print head while drops are ejected from the head.

SUMMARY

In one aspect, a device for depositing drops includes a head configured to eject drops on a region of a substrate, a stage configured to hold the substrate while the head ejects drops on the region of the substrate, a first transporting device configured to transport the substrate in a transporting direction onto the stage, and a second transporting device configured to transport the substrate in the transporting direction off the stage. The stage and at least one of the first transporting device or the second transporting device are movable together in the transporting direction.

Implementations can include one or more of the following features. A control unit may be operatively coupled to the head, the stage, the first transporting device and the second transporting device, and the control unit may be configured to cause the head to eject drops while the stage is moving in the transporting direction. The head may have multiple nozzles that defines an array of rows and columns. The head may be movable in a scanning direction that is perpendicular to the transporting direction. The substrate may be continuous. The stage may be larger than the region of the substrate. A cutter may be configured to cut the substrate. A detector may detect a fiducial mark on the substrate. A motor may move the stage perpendicular to the transport direction or rotate the stage. A stack may receives the substrate. The stack and the stage may be movable together in the transporting direction. The first transporting device may be a feed roller or a pinch roller. The second transporting device may be a take-up roller or a pinch roller. A linear motor may move the stage and at least one of the first transporting device or the second transporting device.

In one aspect, a method for depositing drops includes transporting a substrate onto a stage by a first transporting device in a transporting direction, holding the substrate on the stage, moving the stage and at least one of the first transporting device or a second transporting device together in the transporting direction while a head ejects drops on a region of the substrate, releasing the substrate by the stage, and transporting the substrate from the stage by the second transporting device in the transporting direction.

Implementations can include one or more of the following features. The substrate may be positioned in response to the detection of a fiducial mark on the substrate by a detector. The head may approach the substrate before ejecting the drops on the region of the substrate. The stage may approach the head before the head ejects the drops on the region of the substrate. The head may leave the substrate after ejecting the drops on the region of the substrate. The stage may leave the head after the head ejects drops on the region of the substrate. The substrate may be cut before the head ejects drops on the region of the substrate. The substrate may be cut after the head ejects drops on the region of the substrate. A stack that receives the substrate may be moved in the transporting direction.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

A potential problem in printing on a moving substrate, such as a moving sheet, e.g., a web, is "fluttering" and "weaving" of the substrate. "Fluttering" refers to motion of the web toward and away from the print head. "Weaving" refers to twisting of the web, i.e., rotation in the plane of the web, relative to the print head. Since the substrate can flutter and weave while it is being transported, it is important to control the distance between the head and the substrate in order to ensure high precision printing. Fluttering and weaving are problems particularly for systems that use a print head having multiple nozzles in an array of rows and columns. In such systems, fluttering can result in uneven spacing between rows of pixels, and weaving can resulting in wavering of the image or uneven spacing of pixels within a row, particularly for a printhead having multiple rows of nozzles. Therefore, precise control of the position of the web is required.

These problems can be addressed in a system that includes a print head, a stage that can hold a substrate, a first transporting device, such as a feed roller and pinch rollers, to move the substrate onto the stage, and a second transporting device, such as a take-up roller or pinch rollers, to remove the substrate form the stage. In this system, the stage and one of the first transporting device and the second transporting device are movable together for precise control of the position of the substrate.

Figure 1:
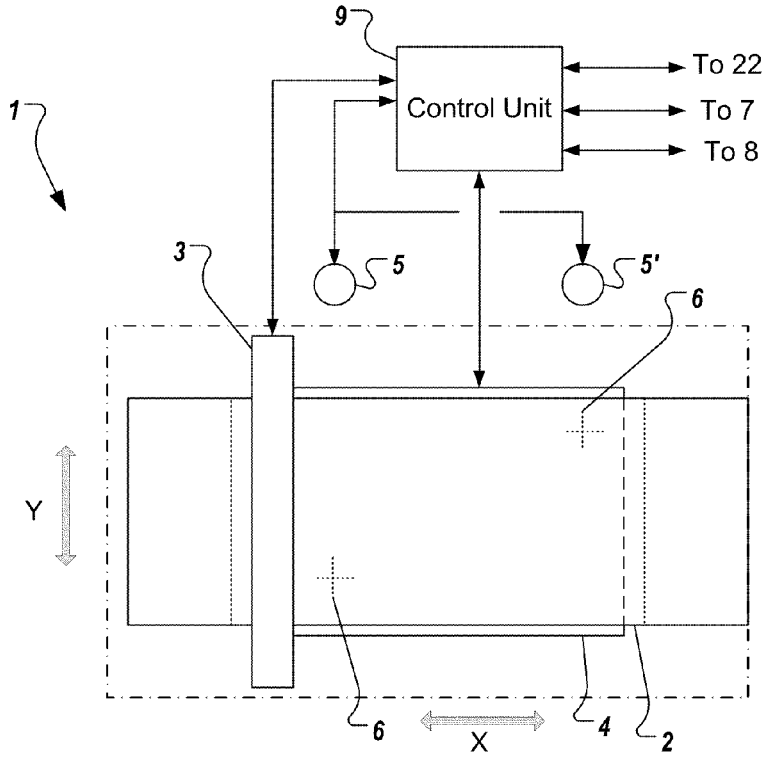
FIG. 1 is a top view of a printer.
Figure 2:
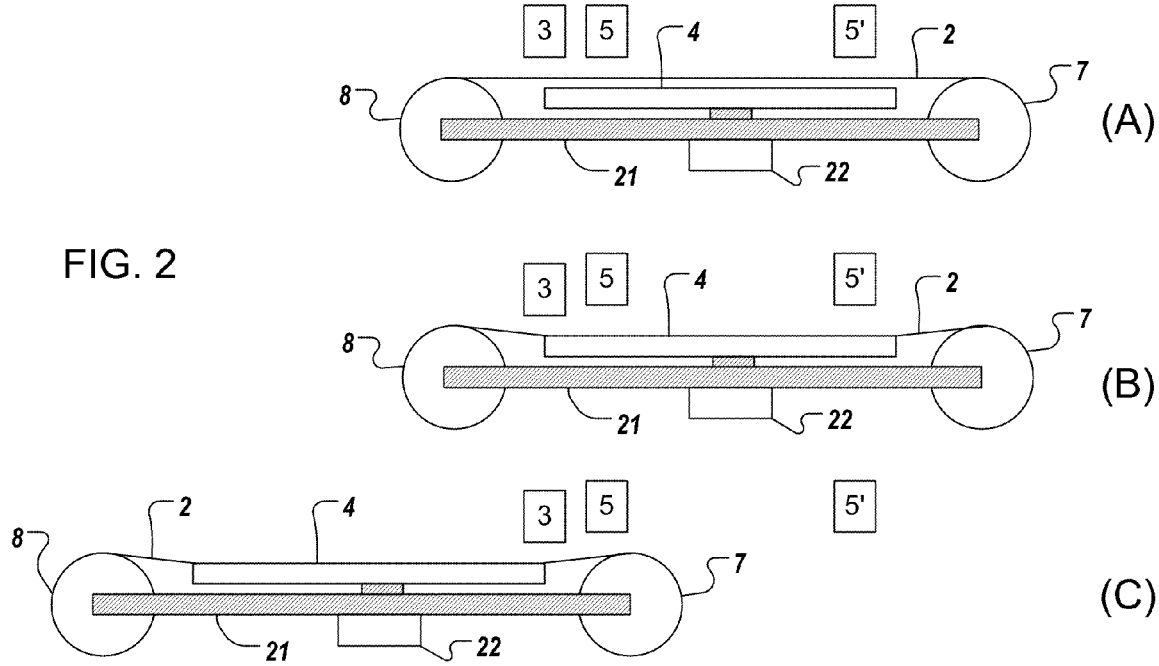
FIG. 2 includes side views of the printer of FIG. 1 illustrating a mode of operation.

FIGS. 1 and 2 show an implementation of an inkjet printer 1 for printing on a substrate 2. The substrate 2 can be a thin continuous sheet, such as paper, a plastic film, or a metal film. The substrate 2 can be an elongated sheet with two ends (rather than a continuous belt). Fiducial marks 6 can be formed on the substrate 2 at regular intervals along its length. The fiducial marks 6 can be preprinted marks on the substrate or apertures or notches formed through the substrate. The fiducial marks 6 can be formed on opposite edges of the width of the substrate 2.

The substrate 2 is wound on a feed roller 7 and a take-up roller 8. The feed roller 7 can feed the substrate 2 in a transporting direction (X direction), and the take-up roller 8 can pull the substrate 2 in the transporting direction. For example, a fresh portion of the substrate 2 is wound around the feed roller 7 and a used (printed upon) portion of the substrate 2 wound around the take-up roller 8. Motors can rotate the rollers 7, 8, to drive the substrate 2.

A stage 4 is positioned under a portion of the substrate 2 between the rollers 7, 8. The stage 4 can be a rigid body, for example a metal body, e.g., made of aluminum or nickel (36%) and iron (64%) alloy. The stage 4 can controllably secure the substrate 2 to the top surface of the stage 4 by means of vacuum suction through holes in the stage 4 or electrostatic force. The feed roller 7, the take-up roller 8, and the stage 4 are connected to a frame 21 so that the stage 4, the feed roller 7, the take-up roller 8 can all be driven simultaneously by a linear motor 22 in the transporting direction. The range of motion of the stage 4 in the X direction as driven by the linear motor 22 should be relatively large, e.g., a substantial portion, e.g., at least a majority, of the length of the stage 4 itself. For example, the stage 4 can be movable along a distance equal to the length of the print area on the substrate 2.

In addition to the motion in the X direction, the frame 21 can be movable in the Y direction and rotatable in the XY plane (R direction) by additional motors, e.g., stepper motors. As this Y and R movement will be used to align the substrate with the columns of nozzles on the print head 3, the range of motion required is significantly smaller than that provided by the linear motor 22, e.g., perhaps up to 1 degree of rotation and up to 2 percent of the length of the stage 4. Alternatively, a frame 23 that supports the print head 3 and detector 5 can be movable in the Y and R directions, e.g., by a stepper motor. Alternatively, the frame 21 can be moveable in only one of the Y and R directions, and the frame 23 can be movable in the other. Alternatively, one of the frame 21 or frame 23 can be moveable only in the R direction (with neither frame movable in the Y direction).

The print head 3 that has nozzles for ejecting fluid drops is positioned above the substrate 2. The fluid ejected from the print head 3 can be ink, but the fluid ejector 3 can be suitable for other liquids, e.g., biological liquids, nano-particle suspensions, or liquids for forming electronic components. The print head 3 can be fixed to the inkjet printer 1 and its length is equal to and wider than the width of the substrate 2 (Y direction, i.e., perpendicular to the X direction). Thus, the stage 4 with substrate attached can be moved past the stationary print head. Also, the print head 3 has a single row of nozzles that defines a line of nozzles, or multiple rows of nozzles that defines an array of rows and columns of nozzles.

One or more detectors 5, 5' that detect the positions of fiducial marks 6 on both edges of the substrate 2 are also positioned above the substrate 2, e.g., above the stage 4. The fiducial marks 6 can be preprinted marks, and the detectors 5, 5' can be optical sensors, e.g., cameras. Alternatively, the fiducial marks 6 can be magnetic, and, the detectors 5, 5' can be magnetic sensors that detects magnetically recorded fiducial marks 6 on the substrate 2. In some implementations, rather than multiple detectors, there is a single detector 5 that can detect the fiducial marks 6, e.g., a camera that can view the entire substrate 2.

A control unit 9 operatively couples to the print head 3, the stage 4, the detector 5, the feed roller 7, the take-up roller 8, and the linear motor 22. The control unit 9 can cause the print head 3 to eject drops while the stage 4 is moving in the transporting direction.

Figure 11:
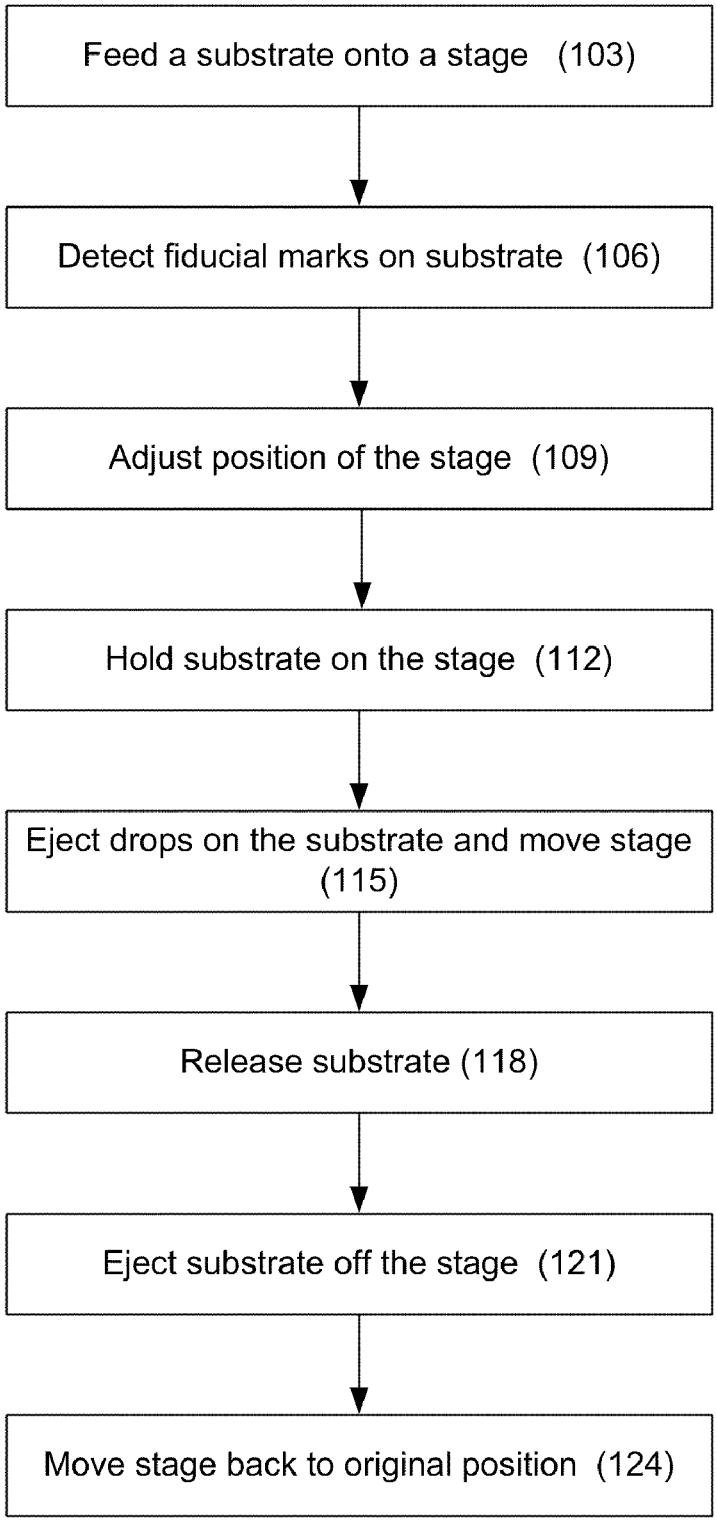
FIG. 11 is a flow chart that shows a print procedure.

Referring to FIG. 11, a flow chart 100 can show a print procedure that is controlled by the control unit 9. First, the feed roller 7 feeds a fresh portion of the substrate 2 onto the stage 4. At the same time, the take-up roller 8 takes up a printed portion of the substrate 2 (step 103 and FIG. 2(A)). The feed roller 7 stops feeding the substrate 2 when a region of the substrate 2 to be printed reaches under the print head 3.

The stage 4 holds the substrate 2 by suctioning air through holes of the stage 4 or electrostatic force so that the substrate 2 is fixed to the stage 4 (step 112). An air pump to apply a vacuum or a power supply to apply a voltage is connected to the stage 4. Before the print head 3 ejects drops, the print head 3 can move downward to decrease the distance between the print head 3 and the stage 4 (FIG. 2(B)), e.g., 0.1 to 1.0 mm. Otherwise, the stage 4 moves upward.

Next, the detector 5 detects the fiducial marks 6 on the substrate 2 in order to measure the position of the substrate 2 (step 106). The control unit 9 receives signals from the detector 5 and adjusts the position of the stage 4 and/or frame 23 so that the substrate 2 is in an expected position in terms of X direction, Y direction, and R direction relative to the print head 3 before printing on the substrate begins, e.g., while no drops are being ejected (step 109). The stage 4 can be positioned in the Y and R directions to hold the substrate 2 so that as the substrate 2 is moved in the X direction, the droplets are deposited in the expected positions. In particular, the stage 4 can be positioned in the R direction so that as the substrate 2 is moved in the X direction, droplets are deposited by a print head 3 having multiple rows and columns of nozzles such that in the printed image the pixels in a row are uniformly spaced. As noted above, only a small range of motion is required for this alignment, e.g., perhaps up to 1 degree of rotation and up to 2 percent of the length or width of the stage 4. The detector 5 and the stage 4 can be calibrated during installation or maintenance of the printer 1. The alignment can occur when no droplets are being ejected.

To print an image, the print head 3 ejects drops on the substrate 2 and concurrently, the stage 4, the feed roller 7, and the take-up roller 8 move in the transporting direction (step 115). These are moved by the linear motor 22 that is controlled by the control unit 9 to synchronize the timing of drops ejection and the linear motor movement. For example, the stage 4 can move along a distance equal to the length of the print area (as defined by the image data to be printed) on the substrate 2, such that the desired print area is printed in a single pass of the stage 4 and substrate 2 past the print head 3. The stage 4 can move along the X direction by an amount about equal to the length of the stage. While the stage 4 is moving in the X direction during droplet ejection, the stage and frame 23 are held stationary in the Y and R directions.

Next, the stage 4 releases the substrate 2 (step 118) after the printing is done and the linear motor 22 stops (FIG. 2(C)). After the step 118, the head 3 moves upward. Next, the second transporting device 8 takes up the substrate 2 from the stage 4 and advances a new fresh portion of the substrate onto the stage 4 (step 121/103). Finally, the linear motor 22 moves the stage back to the original position, which is a position of the stage in step 103. Movement of the stage back to the original position can occur simultaneously with the advancement of the substrate.

Although in the implementation described above the print area is printed in a single pass of the stage 4 past the print head 3, alternatively the print area can be printed in multiple passes, e.g., a first portion of the print area is printed, the substrate 2 is advanced, and then a second portion of the print area is printed. In addition, it may be useful for the stage 4 to make multiple passes past the print head 3 without advancing the substrate 2, e.g., to eject droplets onto a particular location in a controllable number of the passes to provide grayscale.

Figure 3:
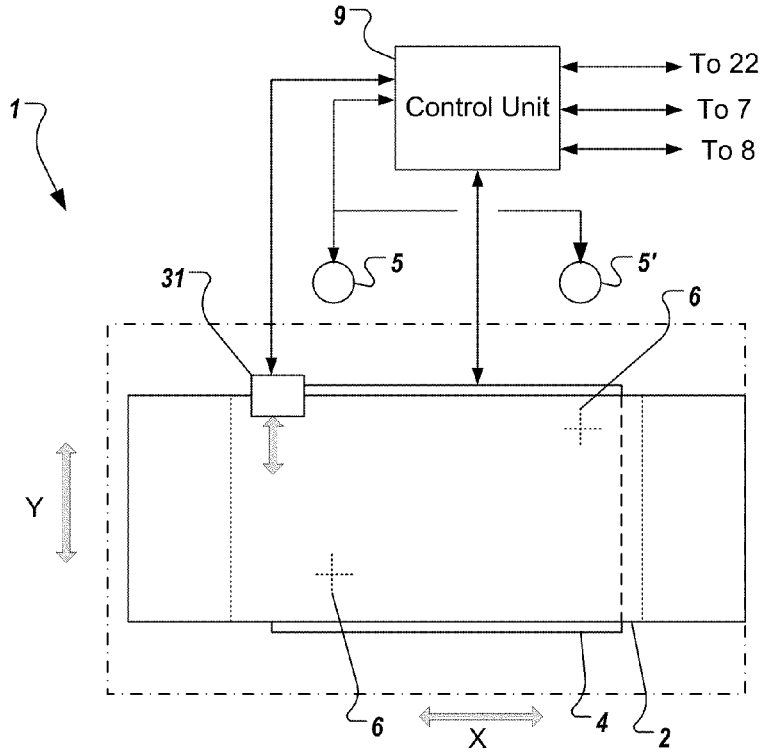
FIG. 3 is a top view of a printer that has a scanning head.
Figure 4:
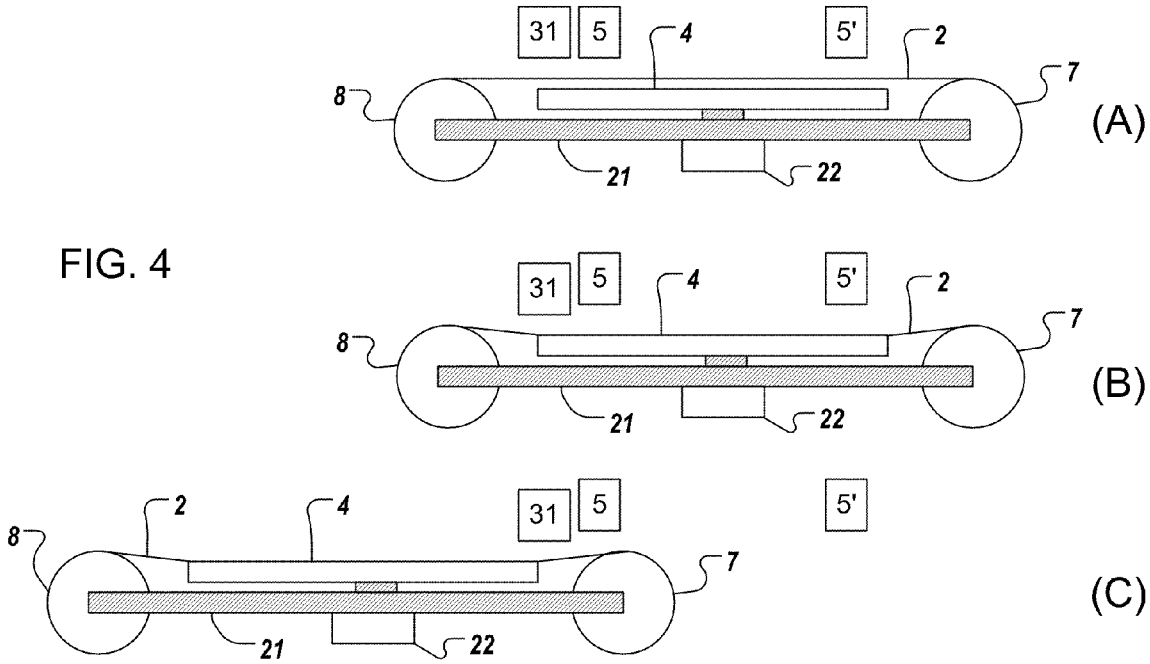
FIG. 4 includes side views of the printer of FIG. 3 illustrating a mode of operation.

FIGS. 3 and 4 show another implementation of an inkjet printer 1 for printing on a substrate 2. This inkjet printer 1 resembles the inkjet printer of FIG. 1, but it has a different print head 31. The print head 31 is positioned above the substrate 2 and is not fixed to the inkjet printer 1. The print head 31, whose length is shorter than the width of the substrate 2 (Y direction), is movable in the Y direction. After the stage 4 holds the substrate 2, the print head 31 ejects drop on it (FIGS. 4(A) and (B)). While the print head 31 ejects drops on the substrate 2, the print head 31 moves in the Y direction. The print head 31 sweeps from one end to the other end of the print area. After the print head 31 reaches the other end of the print area, the substrate 2 is advanced in the transporting direction (FIG. 4(C)).

Figure 5:
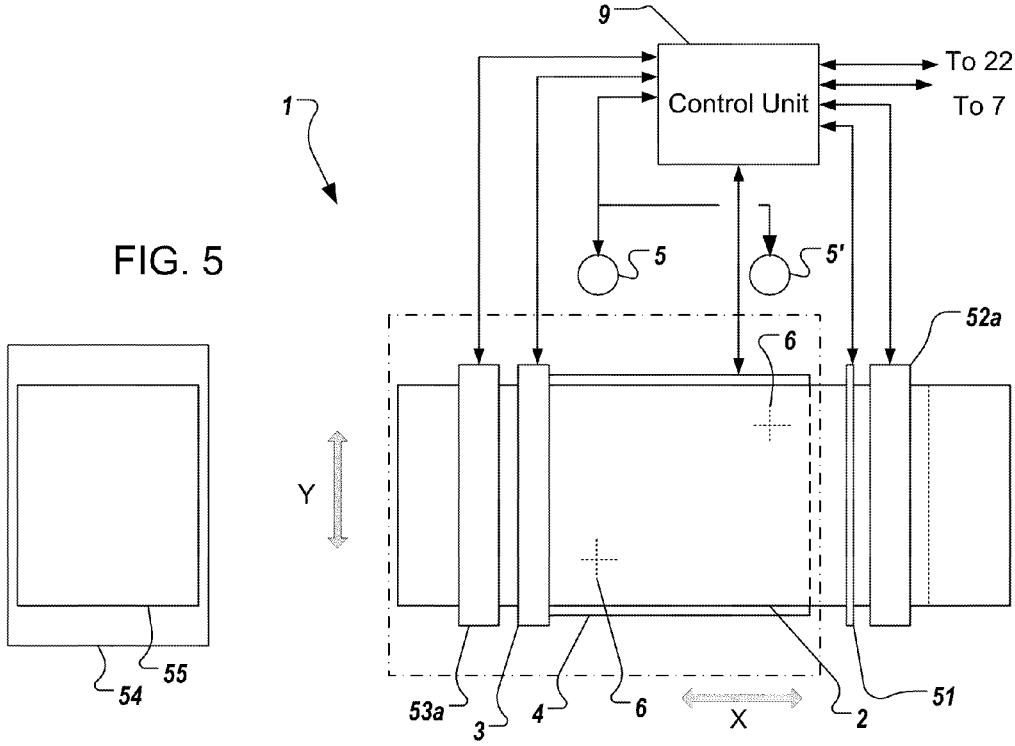
FIG. 5 is a top view of a printer that has a fixed transporting device.
Figure 6:
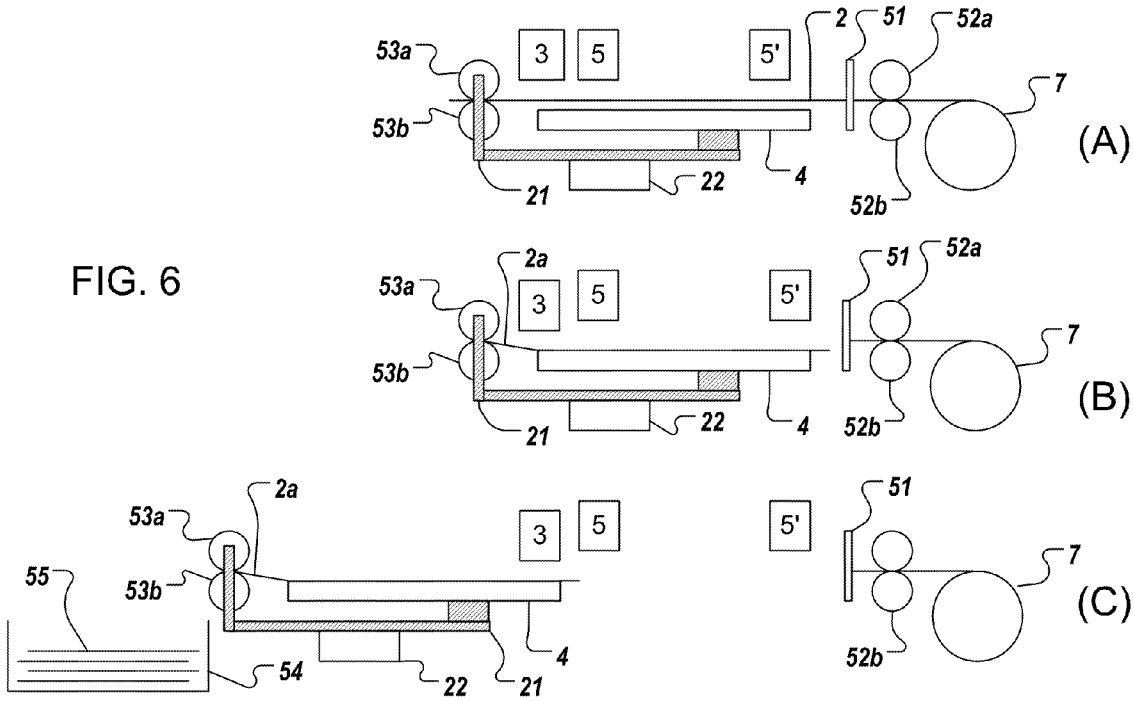
FIG. 6 includes side views of the printer of FIG. 5 illustrating a mode of operation.

FIGS. 5 and 6 show another implementation of an inkjet printer 1 for printing on a substrate 2. This printer has first pinch rollers 52*a*, 52*b* at upstream of the stage 4 and ejection pinch rollers 53*a*, 53*b* at the downstream of the stage 4. There is a cutter 51 between the first pinch rollers 52*a*, 52*b* and the stage 4. The cutter 51 is operatively coupled to the control unit 9 in order to cut the substrate 2 before the stage 4 moves. Also, there is a stack 54 that receives cut substrate 55 at downstream of the ejection pinch rollers 53*a*, 53*b*. The stage 4, the ejection pinch rollers 53*a*, 53*b* and the linear motor 22 are connected to the frame 21 so that the stage 4 and the ejection pinch rollers 53*a*, 53*b* can all be driven simultaneously by the linear motor 22 in the transporting direction. The other parts are same as those of FIG. 1.

After a fresh portion of the substrate 2 is fed from the feed roller 7 onto the stage 4 by the first pinch rollers 52*a*, 52*b*, the cutter 51 cuts the substrate 2 according to signals from the control unit 9 (FIG. 6(A)). Next, the stage holds the cut substrate 2A by suctioning air through holes of the stage 4 or electrostatic force so that the substrate 2 is fixed to the stage 4 (FIG. 6(B)). The control unit 9 receives signals from the detector 5 and adjusts the position of the stage 4 so that the substrate 2 is in an expected position in terms of X direction, Y direction, and R direction relative to the print head 3. While the head 3 ejects drops on the cut substrate 2A, the stage moves in the transporting direction. After the printing is finished, the cut substrate 2A is released and transported to the stack 54 by the ejection pinch rollers 53*a*, 53*b*. In contrast, the feed roller 7, the first pinch rollers 52*a*, 52*b*, and the cutter 51 are fixed to the inkjet printer 1. Finally, the stage 4 and the ejection pinch rollers 53*a*, 53*b* returns to the original position (FIG. 6(A)) and a fresh portion of the substrate 2 is fed onto the stage 4.

Figure 7:
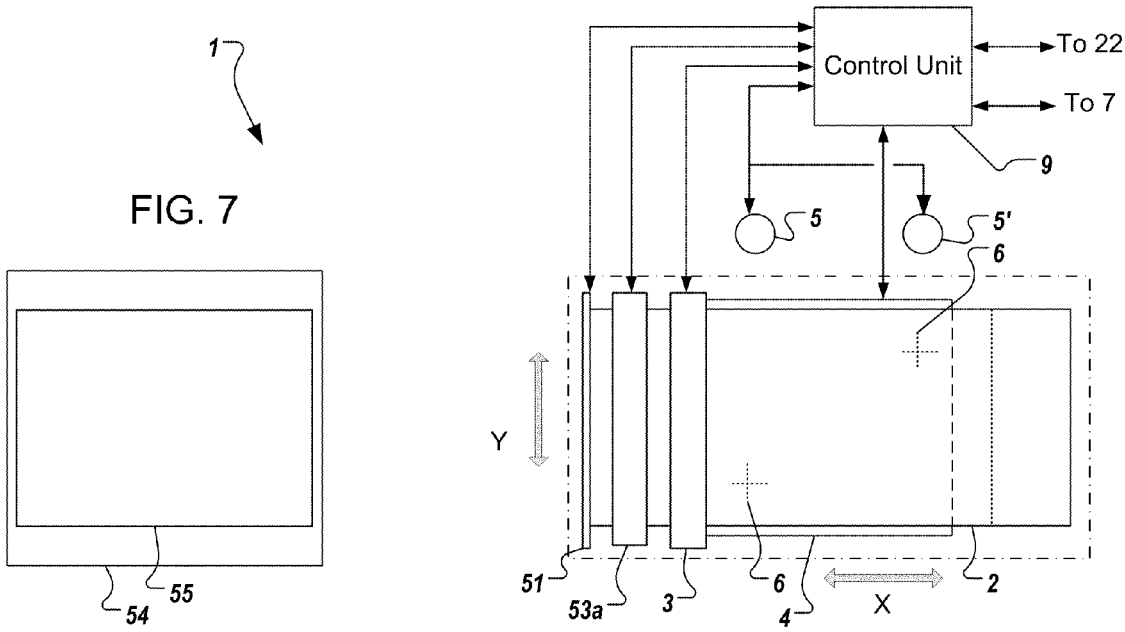
FIG. 7 is a top view of a printer that has a stack.
Figure 8:
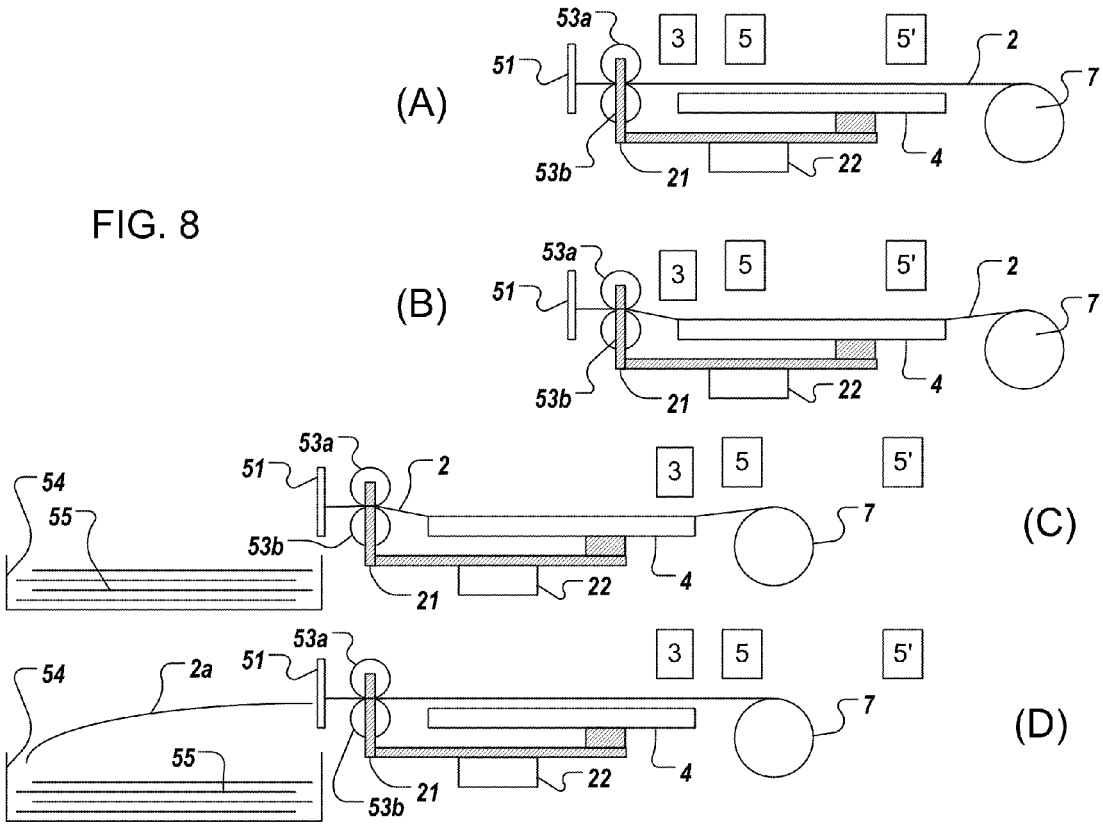
FIG. 8 includes side views of the printer of FIG. 7 illustrating a mode of operation.

FIGS. 7 and 8 show another implementation of an inkjet printer 1 for printing on a substrate 2. This printer has one set of ejection pinch rollers 53*a*, 53*b*. A cutter 51 is positioned at downstream of the ejection pinch rollers 53*a*, 53*b*. A stage 4, a feed roller 7, the ejection pinch rollers 53*a*, 53*b*, the cutter 51, and a linear motor 22 are connected to the frame 21 so that the stage 4, the feed roller 7, the pinch rollers 53*a*, 53*b*, and the cutter 51 can all be driven simultaneously by the linear motor 22 in the transporting direction. Also, there is a stack 54 that receives cut substrate 55 at downstream of the inkjet printer 1. The other parts are same as those of FIG. 1.

After a fresh portion of the substrate 2 is fed onto the stage 4 by the feed roller 7 (FIG. 8(A)), the stage holds the substrate 2 by suctioning air through holes of the stage 4 or electrostatic force so that the substrate 2 is fixed to the stage 4 (FIG. 8(B)). The control unit 9 receives signals from the detector 5 and adjusts the position of the stage 4 so that the substrate 2 is in an expected position in terms of X direction, Y direction, and R rotation direction relative to the print head 3. While the print head 3 ejects drops on the substrate 2, the stage 4 moves in the transporting direction. After the printing is finished (FIG. 8(C)), the substrate 2 is released and transported in the transporting direction by the ejection pinch rollers 53*a*, 53*b*. Next, the cutter 51 cuts the substrate 2 to a predetermined length, and the cut substrate 2A is stacked on the stack 54 (FIG. 8(D)). Finally, the stage 4, the feed roller 7, the ejection pinch rollers 53*a*, 53*b*, and the cutter 51 returns to the original position (FIG. 8(A)) and a fresh portion of the substrate 2 is fed onto the stage 4.

Figure 9:
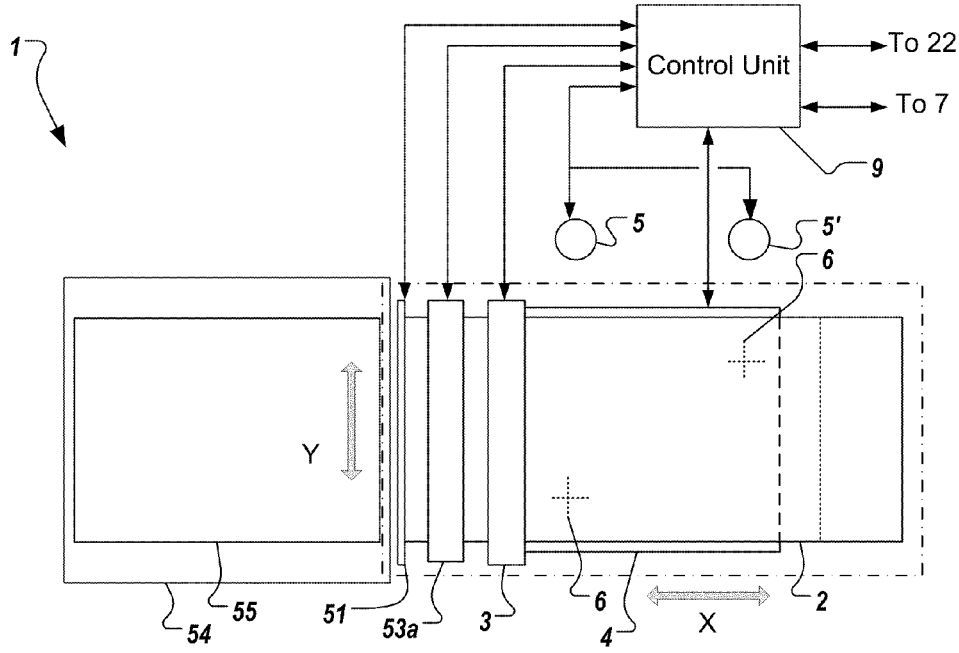
FIG. 9 is a top view of a printer that has a movable stack.
Figure 10:
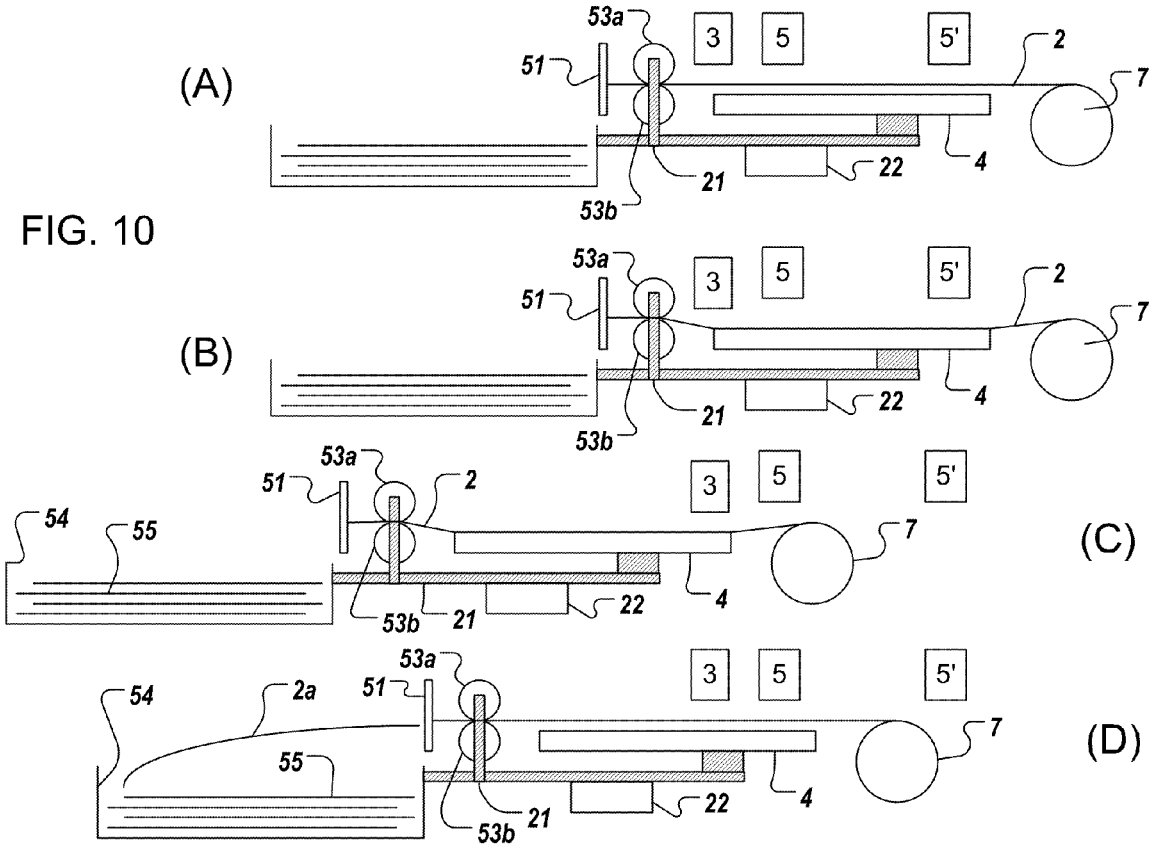
FIG. 10 includes side views of the printer of FIG. 9 illustrating a mode of operation.

FIGS. 9 and 10 show a modified implementation of the inkjet printer 1 described in FIGS. 7 and 8. This printer has a stack 54 that is connected to the frame 21. The other parts are same as those of FIG. 7.

After a fresh portion of the substrate 2 is fed onto the stage 4 by the feed roller 7 (FIG. 10(A)), the stage holds the substrate 2 by suctioning air through holes of the stage 4 or electrostatic force so that the substrate 2 is fixed to the stage 4 (FIG. 10(B)). The control unit 9 receives signals from the detector 5 and adjusts the position of the stage 4 so that the substrate 2 is in an expected position in terms of X direction, Y direction, and R rotation direction relative to the print head 3. While the print head 3 ejects drops on the substrate 2, the stage 4 moves in the transporting direction. After the printing is finished (FIG. 10(C)), the substrate 2 is released (FIG. 10(D)). Next, the substrate 2 is transported to the stack 54 by the ejection pinch rollers 53*a*, 53*b* according to the movement of the frame 21 back to the original position (FIG. 10(E)). Finally, the cutter 51 cuts the substrate 2 to a predetermined length, and the cut substrate 2A is stacked on the stack 54. A fresh portion of the substrate 2 is fed onto the stage 4 (FIG. 10(A)).

A number of embodiments of the invention have been described. Nevertheless, it will be understood that various modifications may be made without departing from the spirit and scope of the invention. For example, the movable print head 3 in FIG. 3 can be used in other implementation, such as FIGS. 5, 7, and 9. In addition, printing methods in the single pass and multiple passes of the stage 4 can be applied to all embodiments. Accordingly, other embodiments are within the scope of the following claims.

What is claimed is:

1. A device for depositing drops comprising:

a head configured to eject the drops on a region of a substrate;

a stage configured to hold the substrate while the head ejects drops on the region of the substrate;

a first transporting device configured to transport the substrate in a transporting direction onto the stage; and a second transporting device configured to transport the substrate in the transporting direction off the stage;

wherein the stage and at least one of the first transporting device or the second transporting device are configured to move laterally relative to the head together in the transporting direction.

2. The device of claim 1 further comprising a control unit operatively coupled to the head, the stage, the first transporting device and the second transporting device, the control unit configured to cause the head to eject drops while the stage is moving in the transporting direction.

3. The device of claim 1 wherein the head has multiple nozzles that define an array of rows and columns.

4. The device of claim 1 wherein the head is movable in a scanning direction that is perpendicular to the transporting direction.

5. The device of claim 1 wherein the substrate is continuous.

6. The device of claim 1 wherein the stage is larger than the region of the substrate.

7. The device of claim 1 further comprising a cutter to cut the substrate.

8. The device of claim 1 further comprising a detector to detect a fiducial mark on the substrate.

9. The device of claim 8 further comprising a motor to move the stage perpendicular to the transport direction.

10. The device of claim 8 where the stage has a face that holds the substrate and further comprising a motor to rotate the stage about an axis perpendicular to the face.

11. The device of claim 1 further comprising a stack that receives the substrate.

12. The device of claim 11 wherein the stack and the stage are movable together in the transporting direction.

13. The device of claim 1, wherein the first transporting device is a feed roller.

14. The device of claim 1, wherein the first transporting device is a pinch roller.

15. The device of claim 1, wherein the second transporting device is a take-up roller.

16. The device of claim 1, wherein the second transporting device is a pinch roller.

17. The device of claim 1 further comprising a linear motor configured to move the stage and at least one of the first transporting device or the second transporting device.

18. The device of claim 1, wherein the stage comprises a rigid body.

19. The device of claim 1, wherein whichever of the first transporting device or the second transporting device other than the at least one of the first transporting device or the second transporting device is configured to remain stationary while the stage and the at least one of the first transporting device or the second transporting device move laterally.

20. A method for depositing drops comprising:

transporting a substrate onto a stage by a first transporting device in a transporting direction;

holding the substrate on the stage;

moving the stage and at least one of the first transporting device or a second transporting device laterally relative to a head together in the transporting direction while the head ejects the drops on a region of the substrate;

releasing the substrate by the stage; and transporting the substrate from the stage by the second transporting device in the transporting direction.

21. The method of claim 20 further comprising positioning the substrate in response to detection of a fiducial mark on the substrate by a detector.

22. The method of claim 20 wherein the head approaches the substrate before ejecting the drops on the region of the substrate.

23. The method of claim 20 wherein the stage approaches the head before the head ejects the drops on the region of the substrate.

24. The method of claim 20 wherein the head leaves the substrate after ejecting the drops on the region of the substrate.

25. The method of claim 20 wherein the stage leaves the head after the head ejects the drops on the region of the substrate.

26. The method of claim 20 further comprising cutting the substrate before the head ejects the drops on the region of the substrate.

27. The method of claim 20 further comprising cutting the substrate after the head ejects the drops on the region of the substrate.

28. The method of claim 20 further comprising moving a stack that receives the substrate in the transporting direction.

* * * * *